US006391445B1

(12) United States Patent
Weihrauch

(10) Patent No.: US 6,391,445 B1
(45) Date of Patent: May 21, 2002

(54) BRISTLE, METHOD FOR PRODUCING SAID BRISTLE AND A DEVICE WITH A BRISTLE OF THIS TYPE

(75) Inventor: Georg Weihrauch, Wald-Michelbach (DE)

(73) Assignee: Pedex & Co. GmbH, Wald-Michelbach (DE)

( * ) Notice: Subject to any disclaimer, the term of this patent is extended or adjusted under 35 U.S.C. 154(b) by 0 days.

(21) Appl. No.: 09/673,355

(22) PCT Filed: Apr. 9, 1999

(86) PCT No.: PCT/EP99/02403

§ 371 Date: Oct. 16, 2000

§ 102(e) Date: Oct. 16, 2000

(87) PCT Pub. No.: WO99/55195

PCT Pub. Date: Nov. 4, 1999

(30) Foreign Application Priority Data

Apr. 24, 1998 (DE) ..... 198 18 345

(51) Int. Cl.[7] ..... D01F 8/00

(52) U.S. Cl. ..... 428/373; 428/374; 428/370

(58) Field of Search ..... 428/370, 373, 428/374

(56) References Cited

U.S. PATENT DOCUMENTS

| | | | | |
|---|---|---|---|---|
| 2,110,371 A | | 3/1938 | Radford | |
| 2,317,485 A | | 4/1943 | Rider | |
| 2,642,705 A | | 6/1953 | Jensen | |
| 3,090,061 A | | 5/1963 | Vernon | |
| 3,325,845 A | | 6/1967 | Wasyl | |
| 3,689,118 A | | 9/1972 | Charvat | |
| 4,263,691 A | | 4/1981 | Pakarnseree | |
| 4,373,541 A | | 2/1983 | Nishioka | |
| 4,627,950 A | | 12/1986 | Matsui | |
| 5,137,039 A | | 8/1992 | Klinkhammer | |
| 5,460,883 A | * | 10/1995 | Barber, Jr. et al. | 428/373 |
| 5,678,275 A | | 10/1997 | Derfner | |
| 6,270,895 B1 | * | 8/2001 | Needham et al. | 428/372 |

FOREIGN PATENT DOCUMENTS

| | | |
|---|---|---|
| DE | 3 22 089 | 2/1919 |
| DE | 10 14 964 | 9/1957 |
| DE | 10 73 434 | 1/1960 |
| DE | 11 40 901 | 12/1962 |
| DE | 32 963 | 11/1964 |
| DE | 31 16 189 | 12/1982 |
| DE | 83 00 846 | 1/1985 |
| DE | 37 17 475 | 12/1988 |
| DE | 195 33 815 | 3/1997 |
| EP | 03 54 352 | 2/1990 |
| FR | 25 46 097 | 11/1984 |
| GB | 992 346 | 5/1965 |
| GB | 13 27 329 | 8/1973 |
| WO | WO93 18 891 | 9/1993 |
| WO | WO98 000 49 | 1/1998 |

* cited by examiner

*Primary Examiner*—N. Edwards
(74) *Attorney, Agent, or Firm*—Paul Vincent

(57) ABSTRACT

A bristle comprises a core of a comparatively rigid, bending-elastic plastics material and at least one layer of a rubber-like plastics material, which is profiled by stamping or embossing against the core. To said layer can be applied a further film-like coating smoothing the profiling. Such a bristle is produced by the co-extrusion of the core and the rubber-like layer and the subsequent stamping thereof against the core. The film-like coating is applied following stamping.

20 Claims, 2 Drawing Sheets

BRISTLE, METHOD FOR PRODUCING SAID BRISTLE AND A DEVICE WITH A BRISTLE OF THIS TYPE

BACKGROUND OF THE INVENTION

The invention relates to a bristle comprising a core of a comparatively rigid, bending-elastic plastic and at least one layer of a rubber-elastic plastic. The invention also relates to a process for the production of such bristles and to implements equipped with such bristles.

Independently of the intended use of a brush, certain fundamental demands are made on the bristles. These more particularly include the bending elasticity, flexural strength and resistance to wear. Further and often very differing requirements result from the intended use of the brush. Thus, e.g. brushes for oral and body hygiene must be sufficiently soft to avoid injury, whereas abrasively acting, industrial brushes must have hard and rough bristles. Other technical brushes, such as car wash brushes, must once again be smooth and pliable. This also applies in the case of polishing brushes. Brushes or paintbrushes used for the application of media, must have relatively closely juxtaposed, standing bristles for storing the medium, whereas in other applications individual standing bristles or bristle bundles are desired.

The action of a bristle on the surface of the object to be treated or worked is decisively dependent on the surface characteristics thereof and the bristle material. Generally bristles are produced from extruded plastic monofilaments. As a result of the choice of the plastic it is essentially only possible to influence the bending and wear resistance, but only to a very limited extent the surface characteristics and the effectiveness of the surface, apart from simple longitudinal profiles. Thus, numerous attempts have been made in the prior art to modify the surface characteristics or the effectiveness of the surface of bristles by additional measures in order to better meet the requirements of each intended use.

Prior art documents describe bristles with incorporated, abrasively acting particles for different uses. It is in each case a question of giving the bristle a hard, abrading action.

Another development referred to in prior art is to profile in different ways the jacket of a bristle formed from a plastic monofilament. It is in each case a question of forming more or less sharp edges and this extends to frayed structures.

All the aforementioned solutions with particle-filled or profiled, monofilament bristles suffer from the decisive disadvantage that the strength characteristics, particularly the bending elasticity, flexural strength and also the resistance to wear are significantly reduced, so that use must once again be made of larger bristle diameters and/or higher quality plastics. However, this is often impossible for use reasons and also leads to undesired higher costs.

Other known proposals aim at producing the bristle from two plastic components, namely a plastic core and a coating applied thereto either in the form of a jacket enveloping the core or in the form of fibers applied to the core. In these known solutions the strength characteristics of the bristle remain substantially controlled. To the extent that the core has a smooth-walled jacket, the bristle action can only be insignificantly modified. If only the hard core is profiled and a profile-following, rubber-elastic coating is applied the latter is rapidly worn away at the profile humps and the hard core is exposed. To the extent that the core is flocked with fibers, the bristle can only be used for specific purposes and is also complicated and expensive to manufacture.

Prior art has proposed a bristle comprising an extruded, relatively stiff core of PA (polyamide) or high density PE (polyethylene) and a soft, thermoplastic coating of natural or artificial rubber. This known bristle is designed for toothbrushes, where the soft, rubber-elastic coating is mainly intended to ensure a careful treatment of the teeth and gums, whilst the stiff core ensures the necessary strength characteristics for the bristle. However, such a bristle does not satisfy the demands made during cleaning, because its surface is too smooth. It is also unsuitable for applying media to an object.

On the basis of this prior art, the problem of the invention is to provide a bristle which, whilst maintaining the necessary strength characteristics in the case of a soft surface also provides a good cleaning action and absorptivity for media.

On the basis of a bristle comprising a core of a comparatively rigid, bending-elastic plastic and at least one layer of a rubber-elastic plastic, the invention solves this problem in that the rubber-elastic layer is profiled by stamping against the core, preferably by hot stamping.

SUMMARY OF THE INVENTION

The invention is based on the surprising finding that a rubber-elastic plastic, e.g. a thermoplastic elastomer, even with a very limited thickness, which necessarily arises in the case of bristles and with toothbrushes is only a few tenths of a millimeter, can be profiled by stamping or embossing, without there being any shape recovery of the rubber-elastic plastic. A decisive part is played by the relatively rigid core against which the stamping or embossing forces can be applied. It is possible to implement fine to coarse structures with any random shaping. Small profile depths are in particular chosen in the case of bristles for oral and body hygiene, whereas greater profile depths are used for cleaning or coating brushes for in the first case receiving dirt and in the second application media.

The rubber-elastic layer can surround the core in jacket-like manner or also only zonally and the profiling resulting from stamping can be provided over the entire length of the bristle or only over partial lengths thereof.

In the case of the bristle constructed according to the invention the core is made from a plastics material defining the bending and flexural strength of the bristle and the rubber-elastic layer with its profiling from a plastics material defining the surface action of the bristle on the object and the resistance to wear. Through the choice of the two plastics and the nature of the profiling, the bristle can be readily adapted to random requirements.

In a preferred embodiment the core is made from a plastics material having a Shore hardness D>45 and the rubber-elastic layer from a plastics material with a Shore hardness D<35. In a particularly preferred embodiment the Shore hardness of the core plastic is D>65 and that of the rubber-elastic layer 20<D<35. Materials fulfilling the aforementioned requirements are e.g. in the case of the core PE (polyethylene), PP (polypropylene) or PA (polyamide) and for the rubber-elastic layer thermoplastic elastomers.

The profiling of the rubber-elastic layer can be formed by locally defined depressions distributed over the circumference. Instead of this the profiling can also run in the bristle extension direction, e.g. along generatrixes or in helical manner. Finally, the profiling can also be preponderantly oriented transversely to the bristle extension direction.

According to a further feature of the invention, to the profiled, rubber-elastic layer is applied a film-like coating of a soft plastic clinging to its profile. As a result a certain smoothing effect can be obtained on the profiling without removing the surface action therefrom.

The core can be formed from one or more monofilaments. The first-mentioned form is recommended for toothbrushes and body brushes, whereas the second is better for industrial brushes and in particular car wash brushes. In this particular application the bristles must be bending-soft, so as to be applied in optimum manner to the contour of the surface to be cleaned and also so as to carefully clean the surface. These bristles are subject to very rapid wear from the free end. This means in the case of the bristle according the invention, that the rubber-elastic layer is firstly worn away at the bristle ends. In the variant according to the invention with several core monofilaments they are exposed in the form of fibers, which then still ensure a careful action compared with a single, larger diameter ore monofilament.

Normally bristles have a circular cross-section. However, in the case of the construction according to the invention it is possible to implement any other bristle cross-section, in that the core has a cross-section diverging from the circular shape, e.g. a narrow, rectangular or cruciform or stellate cross-section. The rubber-elastic layer can then have a circular cross-section, so that it has a different thickness and can e.g. be more deeply stamped in the thicker areas. Instead of this it can also have a cross-section following the core cross-section, so that independently of the location of the stamping equal-depth profiles can be produced and here again the core serves as an abutment.

Finally, the entire bristle constituted by the core and rubber-elastic layer can be corrugated transversely to the bristle extension direction.

A good adhesion of the rubber-elastic layer to the core is obtained through a surface structure on the core acting as a primer.

For the manufacture of the above-described bristle, the invention proposes a process in which the core and the rubber-elastic layer are co-extruded as a strand and the rubber-elastic layer, with the strand moving, is profiled by stamping against the core.

This process leads to a continuous bristle material, from which the bristles can be cut, as desired, to length immediately after stamping. Instead of this the bristle material can be wound and then the bristle is cut to length, as desired, from the unwound strand at the time of brush manufacture.

In another variant of the process, the core and the rubber-elastic layer are co-extruded as a continuous strand, the strand is wound and the rubber-elastic layer is profiled by stamping against the core on unwinding the strand. In this process stamping can take place at the bristle material manufacturer or only at the brush manufacturer. This process can also be advantageous if the rubber-elastic layer is constituted by a slowly cross-linking elastomer and the stamping process is only to take place at the end of the cross-linking reaction.

In this process the rubber-elastic layer is preferably profiled by stamping tools acting against one another and against the core and said tools can produce different profiles. In the case of an only one-sided profiling the stamping tool cooperates with an non-profiled counter-tool.

In a further variant of the process according to the invention, to the profiled strand at the time of bristle material manufacture or prior to the cutting to length of the bristles, a soft plastic can be applied in film-like manner by extrusion, dipping, spraying or the shrinking on of a film, e.g. in order to smooth the profile.

In another variant of the process, the core and the rubber-elastic layer are co-extruded as a strand, the bristle is then cut to length from the strand and then the rubber-elastic layer is profiled by stamping against the core. In this process the film-like coating can be applied before or after cutting to length by dipping, spraying, or shrinking on a film.

The inventively constructed bristle is usable for implements of the most varied types. In the simplest case such a bristle can be directly used as an interdental cleaner, either in the form of a stick or in a similar manner to dental floss.

As opposed to this, a brush is provided with a plurality of bristles constructed according to the invention and said bristles can be provided in separate arrangements. In particular, such a brush can have bristles with differently profiled, rubber-elastic layers.

The invention is described in greater detail hereinafter relative to embodiments diagrammatically represented in the attached drawings and which in each case perspectively show in cross-section a bristle.

DESCRIPTION OF THE PREFERRED EMBODIMENT

Figure 1:
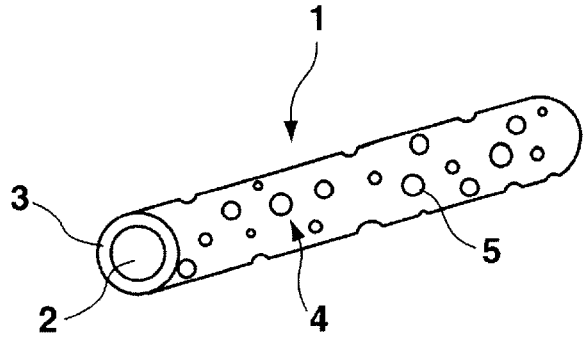
FIG. 1 shows a first embodiment of the invention with surface profiling along an entire extension of the bristle.

The bristle 1 according to FIG. 1 has a core 2 of a bending-elastic, flex-resistant plastic, e.g. PA, PP or PE and a rubber-elastic layer 3 surrounding in jacket-like manner the core 2, e.g. of a thermoplastic elastomer. In the rubber-elastic layer 3 is stamped a profile 4 in the form of locally defined, circumferentially distributed depressions 5. Stamping takes place against the rigid core 2.

Figure 2:
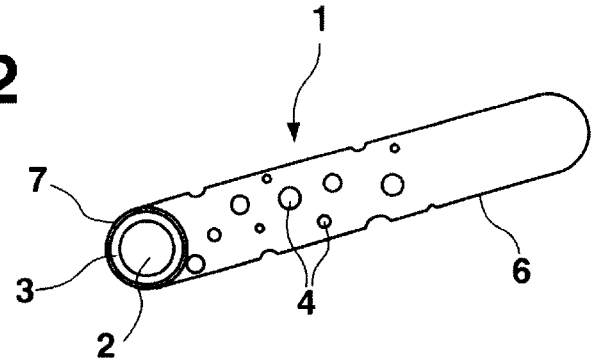
FIG. 2 shows a second embodiment with surface profiling along a partial extent of the bristle.
Figure 3:
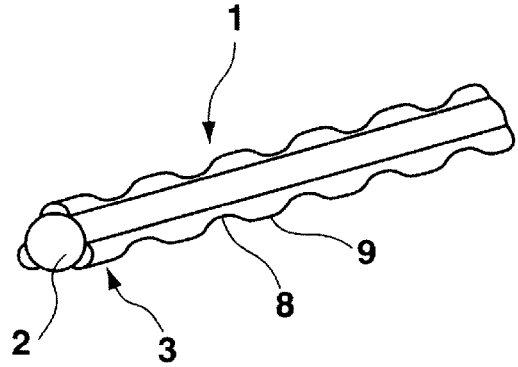
FIG. 3 shows a third embodiment having zonally applied, embossed longitudinal ribs.

In the embodiment according to FIG. 2 the bristle 1 is only stamped with the profile shown in FIG. 1 over part of its length, whereas it is non-profiled over the remaining length 6, which e.g. includes the fastening-side end of the bristle. It otherwise once again comprises a core 2 of a rigid plastic, the rubber-elastic layer 3 with the stamped in depressions and a film-like coating 7, which covers the profiling and clings to the latter, but leads to a certain smoothing effect. In the embodiment of FIG. 3 the bristle once again comprises a core 2 and a rubber-elastic layer 3, which is only zonally applied and runs on the core 2 in the form of longitudinal ribs, which are profiled by transverse stamping, so as to obtain depressions 8 and boss-like humps 9.

Figure 4:
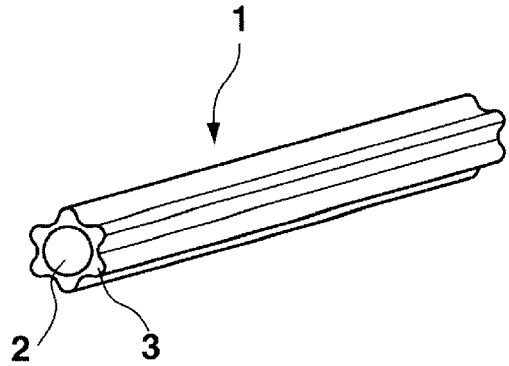
FIG. 4 shows a fourth embodiment having longitudinal ribs.

In the embodiment according to FIG. 4 the rubber-elastic layer 3 is longitudinally profiled on the core 2 and the profile can be produced during a co-extrusion operation or by stamping. In addition, the rubber-elastic layer 3 can have depressions produced by stamping as in FIGS. 1 and 2 or transverse stampings as in FIG. 3.

Figure 5:
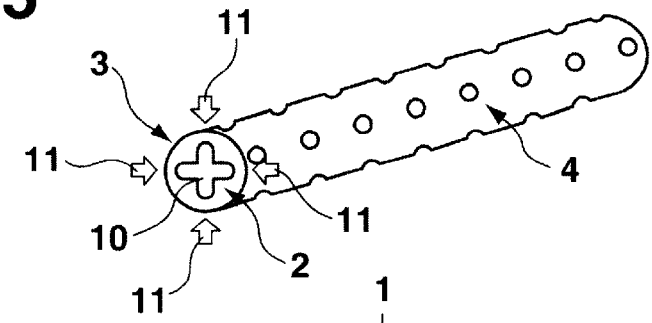
FIG. 5 shows an embodiment having a core of cruciform cross section.

Whereas in the embodiments according to FIGS. 1 to 4 at least the core has a circular cross-section, FIG. 5 shows a bristle with a core 2 having a cruciform cross-section 10, whilst the rubber-elastic layer 3 has a circular cross-section. Thus, it is thinnest in the region of the ends of the beam of the cruciform cross-section 10. This leads to sharply defined abutments against which the profile can be particularly well stamped, as indicated by the arrows 11.

Figure 6:
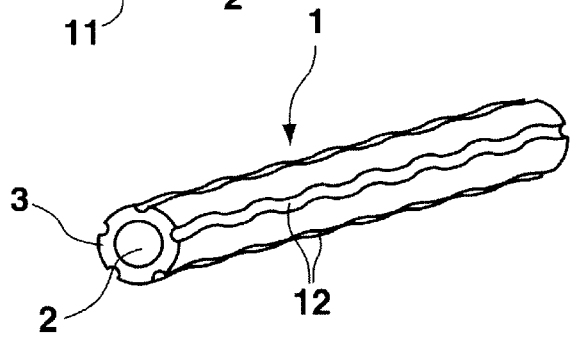
FIG. 6 shows an embodiment with the rubber-like layer stamped with a wavy profile.

In the embodiment according to FIG. 6 the bristle 1 once again has a core 2 with a circular cross-section. The rubber-elastic layer 3 enveloping it is stamped with a wavy profile 12.

Figure 7:
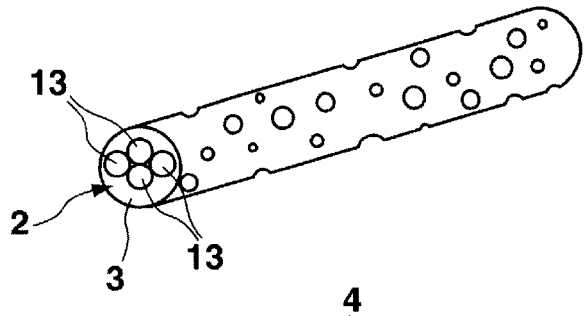
FIG. 7 shows an embodiment having a core of four monofilaments.

FIG. 7 shows an embodiment modified compared with FIG. 1, in that the core 2 comprises four monofilaments 13, which can be positioned parallel or twisted. The rubber-elastic layer 3 once again surrounds the core with a circular cross-section and has on its jacket the stamped in profiling.

Figure 8:
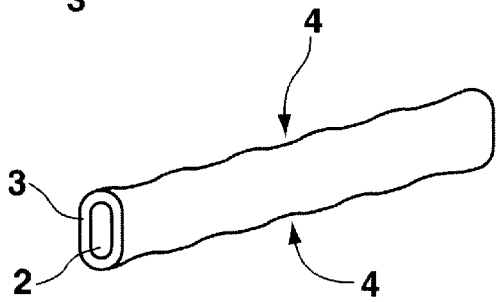
FIG. 8 shows an embodiment having a core with elongated cross section.

In the embodiment according to FIG. 8 the core 2 has an elongated cross-section. The rubber-elastic layer 3 has a constant thickness, so that it follows the cross-section of the core 2 and a strip-like bristle is obtained, which is e.g. only provided on its narrow sides with a stamped profile 4, much as in FIG. 3.

Figure 9:
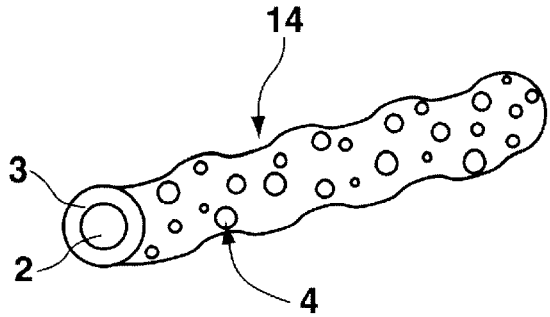
FIG. 9 shows an embodiment having transverse corrugation.

The bristle according to FIG. 9 once again has a core 2 and a rubber-elastic layer 3 with a profiling 4 resulting from stamping. As a variant compared with the previously described bristles, the bristle 14 according to FIG. 9 is corrugated transversely to the longitudinal extension.

I claim:

1. A bristle comprising:

a core made from a substantially hard, bending-elastic plastic; and a rubber-elastic layer disposed, without abrasive additives, on an outer surface of said core, said rubber-elastic layer having an unsmooth surface shaped by stamping against said core.

2. The bristle of claim 1, wherein said rubber-elastic layer is profiled by hot stamping against said core.

3. The bristle of claim 1, wherein said rubber-elastic layer surrounds said core in a jacket-like manner.

4. The bristle of claim 1, wherein said rubber-elastic layer zonally surrounds said core.

5. The bristle of claim 1, wherein said core comprises a plastics material defining a bending and flexural strength of the bristle and said rubber-elastic layer, with its profiling, comprises a plastics material defining a surface action of the bristle on an object and a resistance to wear of the bristle.

6. The bristle of claim 1, wherein said core comprises a plastics material with a Shore hardness D>45 and said rubber-elastic layer comprises a plastics material with a Shore hardness D<35.

7. The bristle of claim 6, wherein said core comprises a plastics material with a Shore hardness D>65 and said rubber-elastic layer comprises a plastics material with a Shore hardness 20<D<35.

8. The bristle of claim 1, wherein said core is made from one of PE (polyethylene), PP (polypropylene) and PA (polyamide) and said rubber-elastic layer is made from a thermoplastic elastomer.

9. The bristle of claim 1, wherein said rubber-elastic layer has circumferentially distributed, locally defined depressions.

10. The bristle of claim 1, wherein said rubber-elastic layer has a profile in an extension direction of the bristle.

11. The bristle of claim 1, wherein said rubber-elastic layer has a profile extending transversely to an extension direction of the bristle.

12. The bristle of claim 1, further comprising a film-like coating of a soft plastics material disposed on said rubber-elastic layer to cling to said structured surface.

13. The bristle of claim 1, wherein said core comprises a monofilament.

14. The bristle of claim 13, wherein said core is formed from several monofilaments.

15. The bristle of claim 1, wherein said core has a non-circular cross-section.

16. The bristle of claim 15, wherein said rubber-elastic layer has a cross-section differing from a cross section of said core.

17. The bristle of claim 16, wherein said rubber-elastic layer has a circular cross-section.

18. The bristle of claim 15, wherein said rubber-elastic layer has a cross-section following said cross section of said core.

19. The bristle of claim 1, wherein said core, with said rubber-elastic layer, is corrugated transversely to an extension direction of the bristle.

20. The bristle of claim 1, wherein said core has at least one of a surface structure and a coating to prime said rubber-elastic layer.

* * * * *